US007714709B1

(12) United States Patent
Daniel

(10) Patent No.: US 7,714,709 B1
(45) Date of Patent: May 11, 2010

(54) MODULAR PLUG AND WEAR COVERT ALARM LOCATOR APPARATUS

(76) Inventor: Sayo Isaac Daniel, 848 Brickell Key Dr., #3402, Miami, FL (US) 33131

( * ) Notice: Subject to any disclaimer, the term of this patent is extended or adjusted under 35 U.S.C. 154(b) by 414 days.

(21) Appl. No.: 11/757,971

(22) Filed: Jun. 4, 2007

Related U.S. Application Data

(63) Continuation-in-part of application No. 11/626,356, filed on Jan. 23, 2007, and a continuation-in-part of application No. 11/619,189, filed on Jan. 2, 2007, and a continuation-in-part of application No. 11/560,762, filed on Nov. 16, 2006, now abandoned, and a continuation-in-part of application No. 10/979,894, filed on Nov. 1, 2004, now Pat. No. 7,265,666.

(51) Int. Cl.
*G08B 1/08* (2006.01)

(52) U.S. Cl. ..... 340/539.11; 340/539.1; 340/539.13; 340/573.1; 340/825.36; 340/825.49

(58) Field of Classification Search ..... 340/539.1, 340/539.11, 539.13, 521, 573.1, 573.3, 825.36, 340/825.49
See application file for complete search history.

(56) References Cited

U.S. PATENT DOCUMENTS 5,574,432 A * 11/1996 McCarthy ..... 340/573.1
5,630,206 A * 5/1997 Urban et al. ..... 455/456.1
5,748,087 A * 5/1998 Ingargiola et al. ..... 340/573.7
6,198,431 B1 * 3/2001 Gibson ..... 342/357.07
6,278,370 B1 * 8/2001 Underwood ..... 340/573.1
6,788,200 B1 * 9/2004 Jamel et al. ..... 340/539.13
6,819,258 B1 * 11/2004 Brown ..... 340/825.49
6,868,320 B1 * 3/2005 Burch ..... 701/35
2005/0048955 A1 * 3/2005 Ring ..... 455/414.1
2005/0083195 A1 * 4/2005 Pham et al. ..... 340/539.13

* cited by examiner

*Primary Examiner*—Daryl Pope
(74) *Attorney, Agent, or Firm*—Sanford Jay Asman

(57) ABSTRACT

A plug-in module providing the functionality of a covert alarm and locator apparatus allows the module to be moved between various articles of footwear or other apparel, as desired, and it allows the module to be used for additional purposes, such as pet monitoring, or the inclusion within a golfer's glove having a display which shows the distance to the pin on a particular course. By modularizing the circuitry, it is fast, easy, and inexpensive for a parent to replace a child's footwear when the child needs a larger size. Further, there is no need to have numerous cellular phone or monitoring subscriptions, as they are all tied to a single, moveable module. In addition, traditional competitive apparel manufacturers can each supply units capable of receiving the module on a competitive basis, thereby extending the user's purchase and style options while still providing the benefits of having a covert alarm and locator apparatus, as described.

25 Claims, 6 Drawing Sheets

MODULAR PLUG AND WEAR COVERT ALARM LOCATOR APPARATUS

CROSS-REFERENCE TO RELATED APPLICATIONS

The present application is a continuation-in-part of U.S. patent application Ser. No. 10/979,894, entitled FOOTWEAR COVERT ALARM AND LOCATOR APPARATUS, filed Nov. 1, 2004; Ser. No. 11/560,762, entitled HAND WORN ATTIRE WITH BUILT-IN GPS RECEIVER, filed Nov. 16, 2006; Ser. No. 11/619,189 entitled FOOTWEAR WITH INTEGRATED VIDEO GAMING APPARATUS, filed Jan. 2, 2007; and Ser. No. 11/626,356 entitled BACKPACK HAVING A COVERT ALARM AND LOCATOR APPARATUS, filed Jan. 23, 2007, all by the present inventor, the priority of all of which are claimed, and the contents of all of which are hereby incorporated by reference.

BACKGROUND OF THE INVENTION

1. Field of the Invention

The present invention relates generally to an article of apparel, such as footwear, or the like, and to items which are of a nature to be commonly worn or carried by a person or pet. More specifically, the present invention relates to such an article which has an alarm circuit that can be covertly, selectively engaged by the wearer (or carrier thereof), or by one who has the legal right to act on behalf of the wearer (or carrier) of the item or article. In particular, the present invention relates to a modular circuit specifically adapted for use in combination with an article of attire, such as footwear, or other items which is worn or carried, and which is adapted to receive and retain the modular circuitry whereby the combination can be used to in selectively send a covert alarm signal to a remote monitoring location, with the covert alarm signal being encoded with the position of the wearer (or carrier) of the article.

2. Description of the Prior Art

In the past, there have been other alarm devices designed for use with articles and apparel. Typically, though, such devices provided a "local" alarm, i.e., an alarm which employs an audio and/or visible signal to alert nearby persons of the wearer's need for assistance. One such device is described in U.S. Pat. No. 1,658,848 issued to Kalikow on Feb. 14, 1928 in which an electrical circuit connected to an audio alarm is activated upon the wearer stepping on a mat whereby conductive spikes in the wearer's shoe complete an alarm circuit. A similar device is described by Kalikow, et al. in U.S. Pat. No. 1,771,258 which issued on Jul. 22, 1930.

Covert operation of alarm circuit is discussed in U.S. Pat. No. 3,777,086 which issued to Riedo on Dec. 4, 1973 which describes an alarm apparatus in which a toe operated switch in an article of footwear is used to covertly activate a transmitter whereby an alarm circuit in a nearby receiver (i.e., a receiver within the range of transmission) is activated. Another toe switch is described in U.S. Pat. No. 4,350,853 which issued to Ganyard, et al. on Sep. 21, 1982.

U.S. Pat. No. 4,598,272 which issued to Randall P. Cox on Jul. 1, 1986 describes a different type of alarm device suitable for use by a parent (or pet owner) for locating a child (or pet) in which the child or pet is equipped with a remotely operated audio alarm signaling device, while the parent or pet owned holds a transmitter which can remotely activate that audio alarm, so that it gives off a "raucous" signal, thereby enabling the parent or pet owner to locate the child or pet, so long as they are within range of the audible signal.

U.S. Pat. No. 5,557,259 issued to Musa on Sep. 17, 1996 describes a child-worn transmitter which is used in conjunction with a nearby parent-worn receiver to locate a child who is more than some preset distance from the parent. The parent-worn receiver includes a direction finder to assist in locating the nearby child.

U.S. Pat. No. 5,574,432 which issued to McCarthy on Nov. 12, 1996 describes an ankle and shoe covering device, which is quite apparent to anyone close by which issues an audible signal upon activation of alarm buttons by the wearer. While the patent also discusses transmitting a radio alarm signal, it describes no circuitry capable of so doing.

U.S. Pat. No. 5,748,087 issued on May 5, 1998 to Ingargiola, et al. describes a system for keeping track of a nearby child or Alzheimer's patient. The system includes a pair of units, each having a transmitter and a receiver. The transmitter of the child's (or patient's) unit transmits continuously. The observer's unit monitors that signal, and sends out a signal to the child's (or patient's) unit to cause that unit to provide audio and visual alarms should the child (or patient) wander too far away (e.g., when the signal strength of the child's, or patient's, transmitter decreases below a preset threshold). Alternatively, the observer can remotely initiate an alarm from the child's (or patient's) unit by transmitting a signal to that unit.

U.S. Pat. No. 5,905,461 which issued to Neher on May 18, 1999 describes a tracking system in which the tracked person wears a wristband device which includes a Global Positioning System ("GPS") receiver. The device is mounted in a wristband which locks on the wearer's wrist, and which continuously transmits a location signal to a nearby relay station, which has the capability of further transmitting the wearer's location to a tracking satellite, for further relay to a monitoring station. Shortcomings of this system include both the "always on" feature, and the need for a very expensive, dedicated infrastructure (e.g., the relay stations and tracking satellites). The shortcomings of an "always on" system are that they have very limited battery life, and that they deprive the wearer of privacy. Further, anyone with an RF monitor can triangulate on the transmitter of an "always on" system, even if they cannot decode the signal being transmitted to get the GPS location information. Similar systems are also described b Neher in U.S. Pat. No. 6,362,778 which issued on Mar. 26, 2002 and U.S. Pat. No. 6,388,612 which issued on May 14, 2002.

U.S. Pat. No. 6,278,370s issued to Underwood on Aug. 21, 2001 addresses the need for a system which can be activated on demand, so as to conserve battery life, and it also addresses the need to use the existing infrastructure to locate someone who is in distress. Thus, Underwood describes the use of either an existing cellular phone system, or an existing low earth orbit satellite monitoring system to receive, and relay (to a monitoring location) a distress signal. However, Underwood fails to address a reliable means for locating the party transmitting the distress signal. Consequently, only a relative area (e.g., based on the location of the cell phone towers or the reception area of low earth orbit satellite) can be identified as the location of the party in distress. Obviously, if danger is imminent, or if the party is being abducted (and is in a moving vehicle), such generalized location data is not terribly helpful to those seeking to aid the party in distress, as Underwood does not teach anything about transmitting specific location data of the party in distress.

U.S. Pat. No. 6,788,200 issued to Jamel, et al. describes a GPS based system in which an "always on" module contained in an article of footwear continuously transmits the location of the wearer. As set forth above, the "always on" feature deprives the unit of extended battery life, and it deprives the wearer of privacy, as the wearer is unable to control who is monitoring his precise (e.g., GPS encoded) location, or his relative location (based on triangulation of the transmitted RF signal). Further, the apparatus described by Jamel, et al. lacks the ability to be worn in a covert manner in that it employs external clips to retain the electronics module and it also employs an antenna which is visibly mounted on the tongue of the footwear.

In that none of the foregoing art describes an article of footwear or other worn or carried item containing a GPS unit, together with a cellular phone module which can be selectively activated by the wearer (or carrier of the article) in a covert manner, the present inventor has heretofore filed U.S. patent application Ser. No. 10/979,894, entitled FOOTWEAR COVERT ALARM AND LOCATOR APPARATUS on Nov. 1, 2004 to overcome those shortcomings of the prior art. As described therein, an electronics module could be covertly mounted in the sole of an article of footwear, such as an athletic shoe. The shoe described therein includes a covert activation switch, which the wearer can selectively press, to cause the module to encode its present location based on receiving a GPS signal which is then transmitted by included cellular phone circuitry to a remote monitoring location from which assistance can be dispatched. Unlike the other prior devices, the system described by the present inventor assures both extended battery life and user privacy by causing transmission of the user's location only upon selective activation of the alarm circuitry. Notwithstanding the benefits provided by the foregoing system, a major portion of the expense of the system is in the electronics module containing the GPS receiver, logic circuitry, and the cellular phone electronics.

SUMMARY OF THE INVENTION

In order to eliminate the shortcomings of the prior art, the present invention is a modularized plug-in unit containing the electronics needed contained in a single module which provides the functionality needed to provide a base carrier unit, which may be worn or carried, with a covert alarm and locator apparatus. In the preferred embodiment of the invention, the module contains an electronics package comprising a GPS receiver, logic circuitry, and a cellular phone module which can be plugged into an article to be worn or carried by an individual, such as an article of footwear. The base carrier article which is intended to house the modularized unit is designed to interface with the modularized unit and it includes a retaining means, such as a cavity, and additional items such as a power button, a covert activation switch, and a GPS antenna. In addition, it may optionally include such items as a power supply or means for charging the battery within the modular electronics package, as well as an external data port for interfacing with circuitry within the electronics module.

DETAILED DESCRIPTION OF THE PREFERRED EMBODIMENTS

Figure 1:
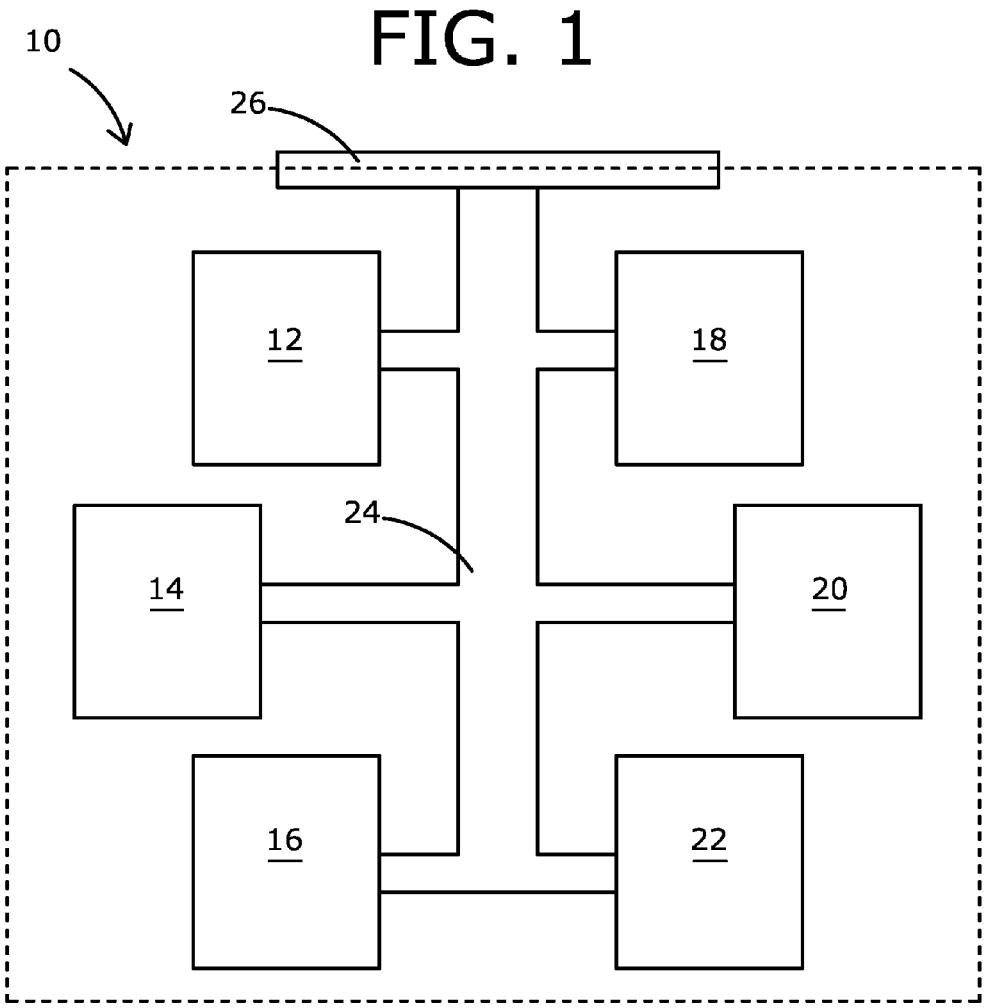
FIG. 1 is a block diagram of the electronics module of the preferred embodiment of the present invention.

As explained above, the present invention is intended to provide an advanced electronics module containing the technology required to provide a user with the functional electronics needed for use in an item of wearable attire or an item which can be carried by the user. While the art cited above discusses a number of ways in which an article of attire, such an athletic shoe, can incorporate a covert alarm locator apparatus using a GPS receiver to provide location information and a transmitter to send the wearer's location information to a remote location upon selective activation by the wearer, a problem with the prior technology which was never addressed relates to the fact that each pair of athletic shoes (or other footwear) or each other item (such as gloves, mittens, or backpacks, as will be explained below), as taught by the prior art, needed to have its own GPS receiver, transmitter, control logic, and power supply. This led to problems in that these electronic items are relatively expensive when compared to the underlying wearable (or carryable) item. Further, while only a transmitter is required for selective activation of the covert alarm, in many cases (e.g., to initiate a search for a lost child or Alzheimer's patient) it has been found to be desirable to allow a "proxy" of the wearer (e.g., one who is legally empowered to act on behalf of the wearer, such as a parent, guardian, caregiver, or other legally authorized person or entity) to have the ability to initiate the covert alarm locator transmission. In those cases, and in such cases as those where someone whose location is to be monitored, e.g., one who is under a court order to remain in, or away from, a particular location, the communications required by the electronics must include a receiver, in addition to the transmitter identified above.

As will be understood, the addition of two-way communications can be accomplished by using cellular technology, such as GSM technology in lieu of a simple transmitter to send the covert alarm signal. However, as GSM communications requires a subscription (with an associated "phone number" and contract) for each cellular module, a user who has either a number of different pairs of footwear, or the desire to use the covert alarm locator apparatus with items other than footwear, would have to have a separate GSM (or other) subscription for each item employing the technology. Further, even if a user had only a single item of footwear employing the present technology, if that item required replacement (e.g., because it wore out, or, in the case of a child, was outgrown) the user would have to purchase a new item of footwear, and again pay for all of the items of electronics, and then transfer his GSM (or other) subscription to the new item.

Finally, in the event that new technology associated with the covert alarm locator apparatus became available, it was heretofore necessary to purchase a completely new item (e.g., a new pair of footwear), to simply obtain the more advanced features.

All of the foregoing problems with the systems of the prior art have been eliminated by the present invention, as will be described in conjunction with the accompanying drawing. With reference to FIG. 1, the present invention comprises an electronics module 10 which includes a number of integrated subsystems. In particular, the module 10 includes location determining circuitry 12, preferably comprising a GPS receiver, as in the preferred embodiment of the invention. Note, though, that if the location determining circuitry 12 is a GPS receiver, it is not necessary for the module 10 to include a GPS antenna.

The electronics module 10 further comprises communications circuitry 14 which enables it to transmit (and, selectively receive) signals from a remote location. In the preferred embodiment of the invention, the communications circuitry 14 is comprised of a GSM cellular phone module which provides transmission and reception capability worldwide through the existing .GSM network. Alternatively, the communications circuitry 14 can be comprised of other cellular phone or satellite phone technologies.

While a minimal electronics module 10 further comprises control and logic circuitry 16, more advanced versions can include additional circuitry, such as a Bluetooth circuitry 18 or WiFi circuitry 20 (or both), as shown. The electronics module 10 also preferably includes power circuitry 22 which can be used to charge a rechargeable battery or "super capacitor" for primary or backup power. Primary power may be supplied in various applications by an external battery, an external charger, or even solar cells, as will be further explained. The various circuits 12, 14, 16, 18, 20, 22 are interconnected within the module 10 by an appropriate buss 24, and they are further connected to a connector 26, which can be of any suitable type, as will be further explained, thereby allowing the module 10 to be installed in, and connected to, a variety of external wearable, or carryable, items.

Figure 2:
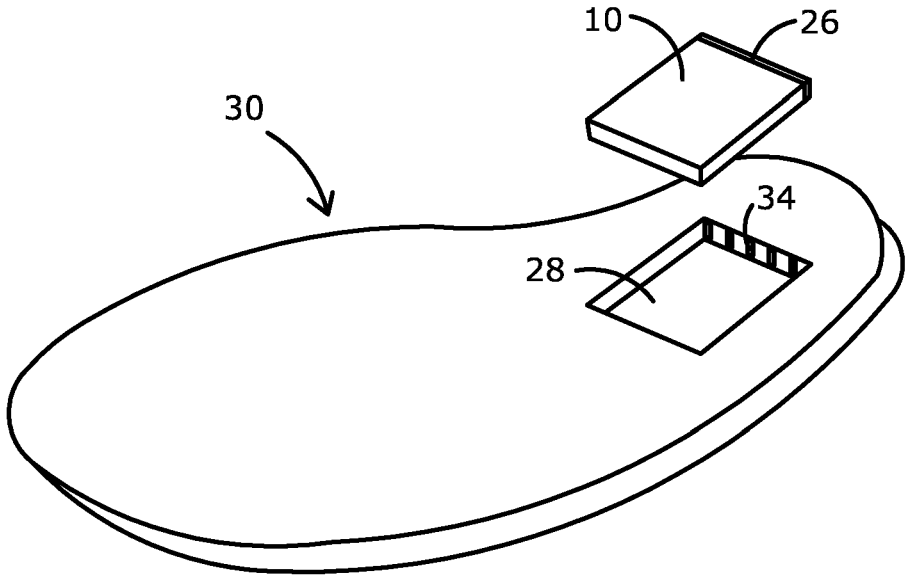
FIG. 2 is an illustrative view of the preferred embodiment of the present invention in which the electronics module of the covert alarm and locator apparatus of the present invention is being mounted into the insole of an athletic shoe.

As those skilled in the art will now recognize, the design of the electronics module 10 of the present invention provides users with a unique way for a user to easily move the module 10 from one item of apparel (e.g., one pair of footwear) to another. In that regard, and with reference now to FIGS. 2 and 3, the electronics module 10 is shown being inserted into a cavity 28 formed in the sole 30 of an article of footwear 32 (shown in shadow in FIG. 3). As will be understood, the insole of the shoe 32 is preferably at least partially removable whereby the cavity 28 is exposed so that the module 10 can be inserted therein such that the connector 26 of the module 10 makes secure contact to a complementary connector 34 in the cavity 28 (See, FIG. 2).

Figure 3:
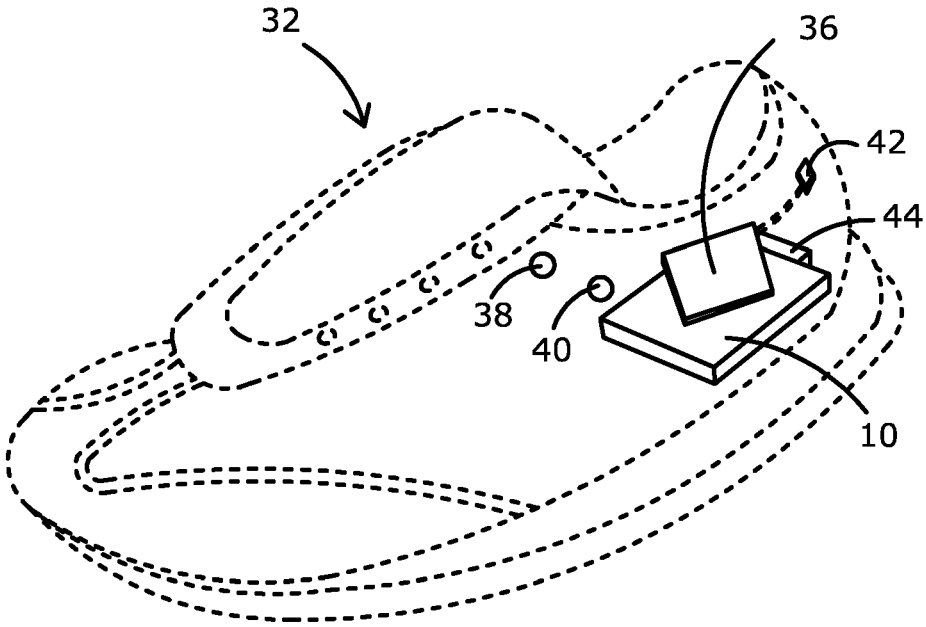
FIG. 3 is a view of the module of the present invention shown in an athletic shoe (shown in shadow)

With continued reference to FIG. 3, the footwear 32 is designed to provide externally accessible features, including such things as a GPS antenna 36, a covert activation switch 38, a power switch 40, and a port 42 (e.g., a mini-USB port, as shown), which can be used as a data port or to attach an external power supply (not shown), to charge a battery which is part of the power circuitry 22 module 10. Optionally, the shoe 32 can also include a battery 44, to supply either primary or supplemental power.

The development of the module 10 provides a unique, and simple way for a user to simply move the module 10 from one item, such as the athletic shoe 32, to another item. Accordingly, if a parent purchases a pair of shoes for a child who subsequently outgrows them, the module 10 provides a very simple, inexpensive way to move the covert alarm locator apparatus to a new pair of shoes. In doing so, the parent's expense is limited solely to the purchase of the new shoes, as there is no need to establish either a new monitoring subscription, or a new account with the provider of GSM (or other) services, nor is there any need to again pay for the electronics which are already present in the module 10. The invention thereby allows numerous, competing, shoe vendors to supply the marketplace with a variety of shoes of different types and styles, all of which are simply made to be compatible with the module 10 by the inclusion of appropriate receptacles for the module 10, and with any other needed external parts (e.g., a GPS antenna and an activation switch).

Figure 4:
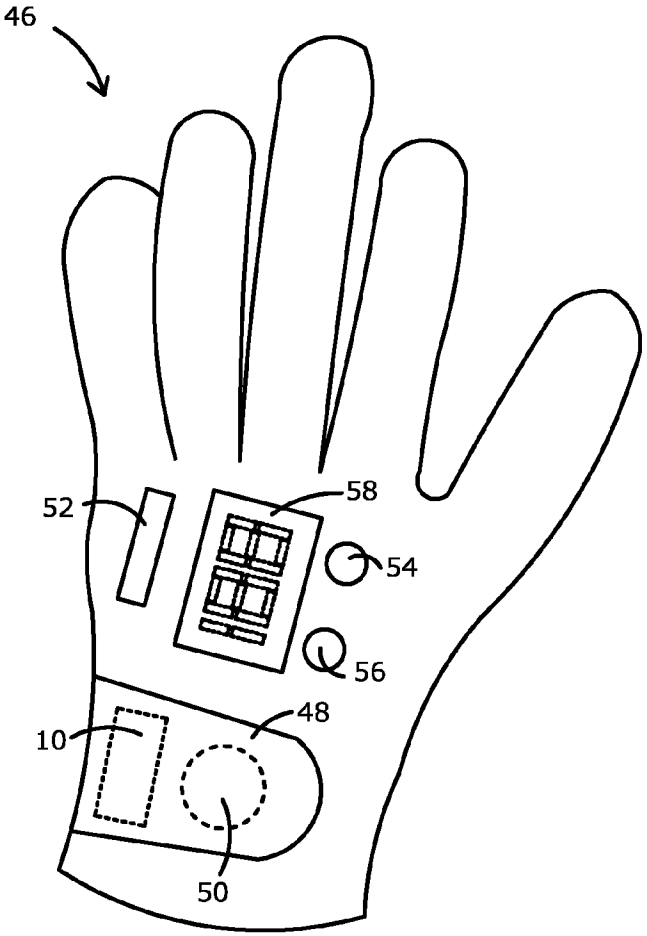
FIG. 4 is a view of the preferred embodiment of the present invention illustrating how it can be used in conjunction with a glove.

In addition, the present invention provides a means by which other items can be used with the covert alarm locator apparatus without the need to purchase additional electronics, whereby the user is able to retain all of the functionality of the electronics module 10, without purchasing additional monitoring or communications subscriptions. Thus, with reference to FIG. 4, a glove 46 having the module 10 inserted into a strap 48, which also houses a battery 50 is shown, the glove 46 is shown to include a GPS antenna 52, a covert activation switch 54, a power switch 56, and an optional display 58. Depending on the type of glove 46, the display 58 can be used to show such things as speed (e.g., if the glove is a ski glove one which is worn in a sport involving the wearer's speed) or distance (e.g., to a finish line in a sport such as sailing, or to the green or cup, in golf). Obviously, if the glove is to be worn as a sports type glove, as just described, additional software of the type applicable to the particular sport, or to the particular golf course, could be programmed into the module 10 which can also include non-volatile, programmable memory for that purpose.

Figure 5:
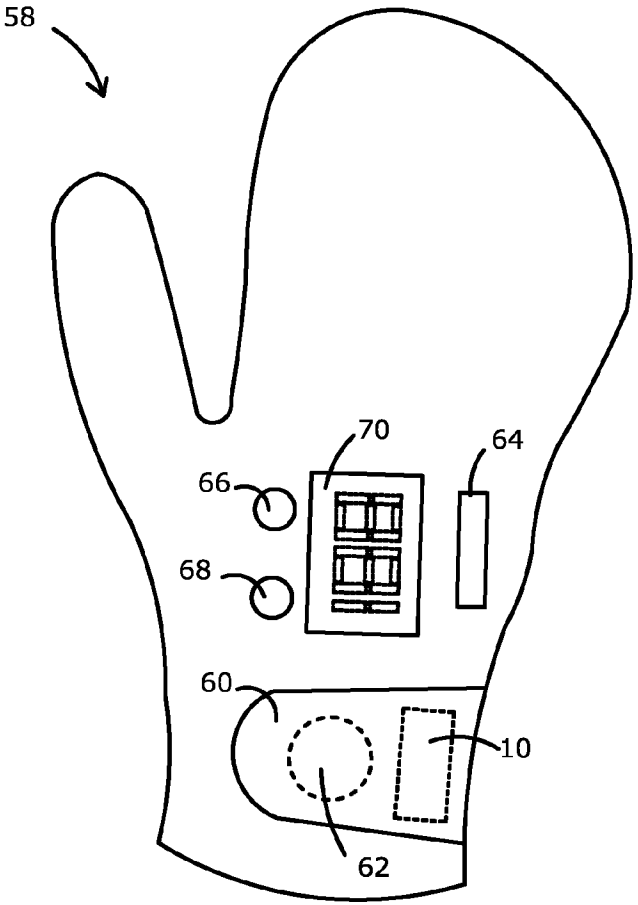
FIG. 5 is a view of the preferred embodiment of the present invention illustrating how it can be used in conjunction with a mitten.

As shown in FIG. 5, a mitten 58, for use in winter sports activities could employ the module 10, housed in a strap 60, along with a battery 62. A GPS antenna 64, and covert activation and power switches 66, 68 are also shown, and, again, a display 70, may be, optionally, included, as well.

Figure 6:
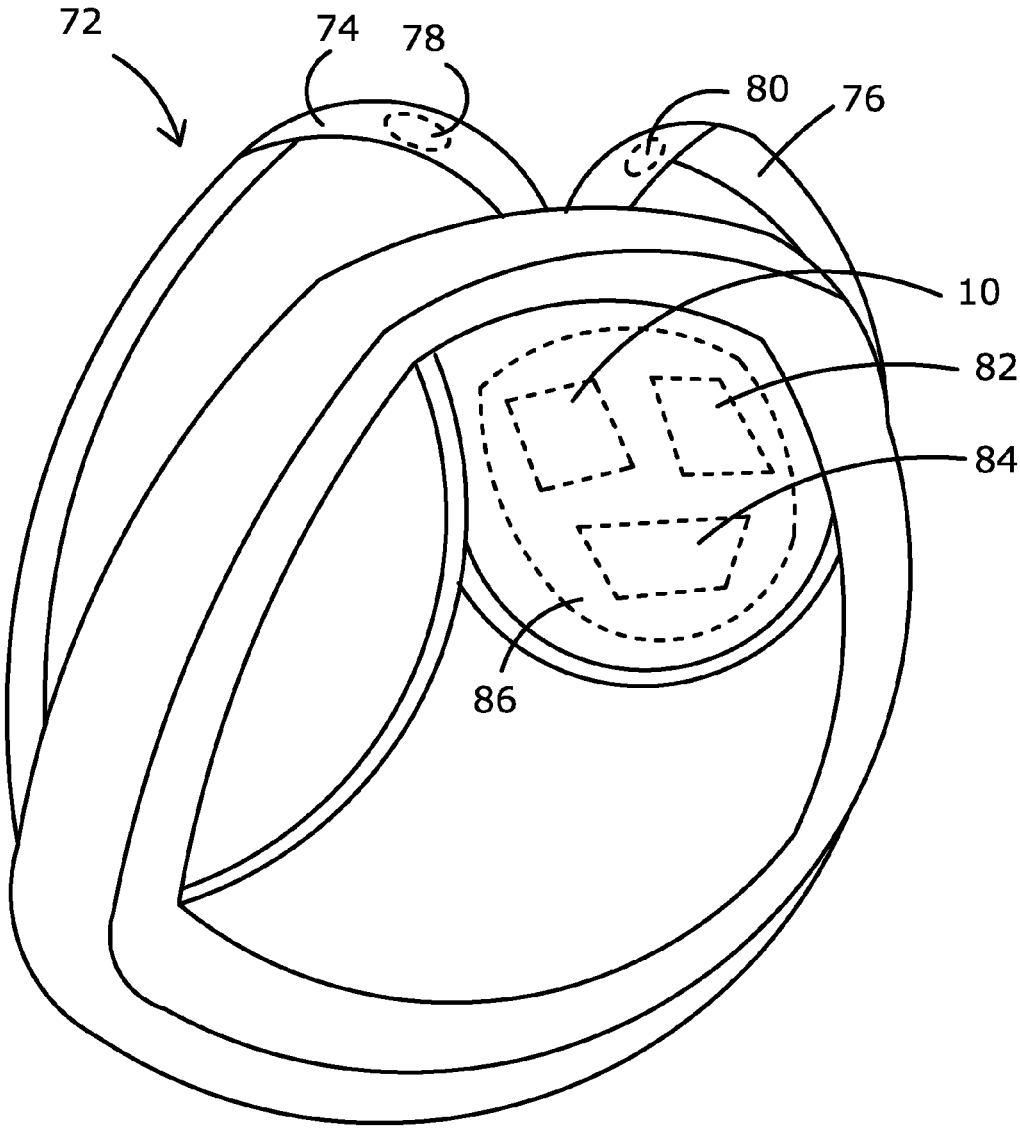
FIG. 6 is a view of the preferred embodiment of the present invention illustrating how it can be used in conjunction with a backpack.

Referring next to FIG. 6 the module 10 of the present invention can also be adapted for inclusion as part of a carryable item, such as a backpack 72, of the typical type having a pair of shoulder straps 74, 76. The backpack 72 can have covert activation and power switches 78, 80 (shown in shadow) conveniently hidden within the straps 74, 76, as shown. A battery 82, and a GPS antenna 84 can also be included as part of the backpack 72 (preferably hidden within a flap 86 as shown in shadow), whereby a child carrying such a backpack could covertly signal for assistance, if needed.

Figure 7:
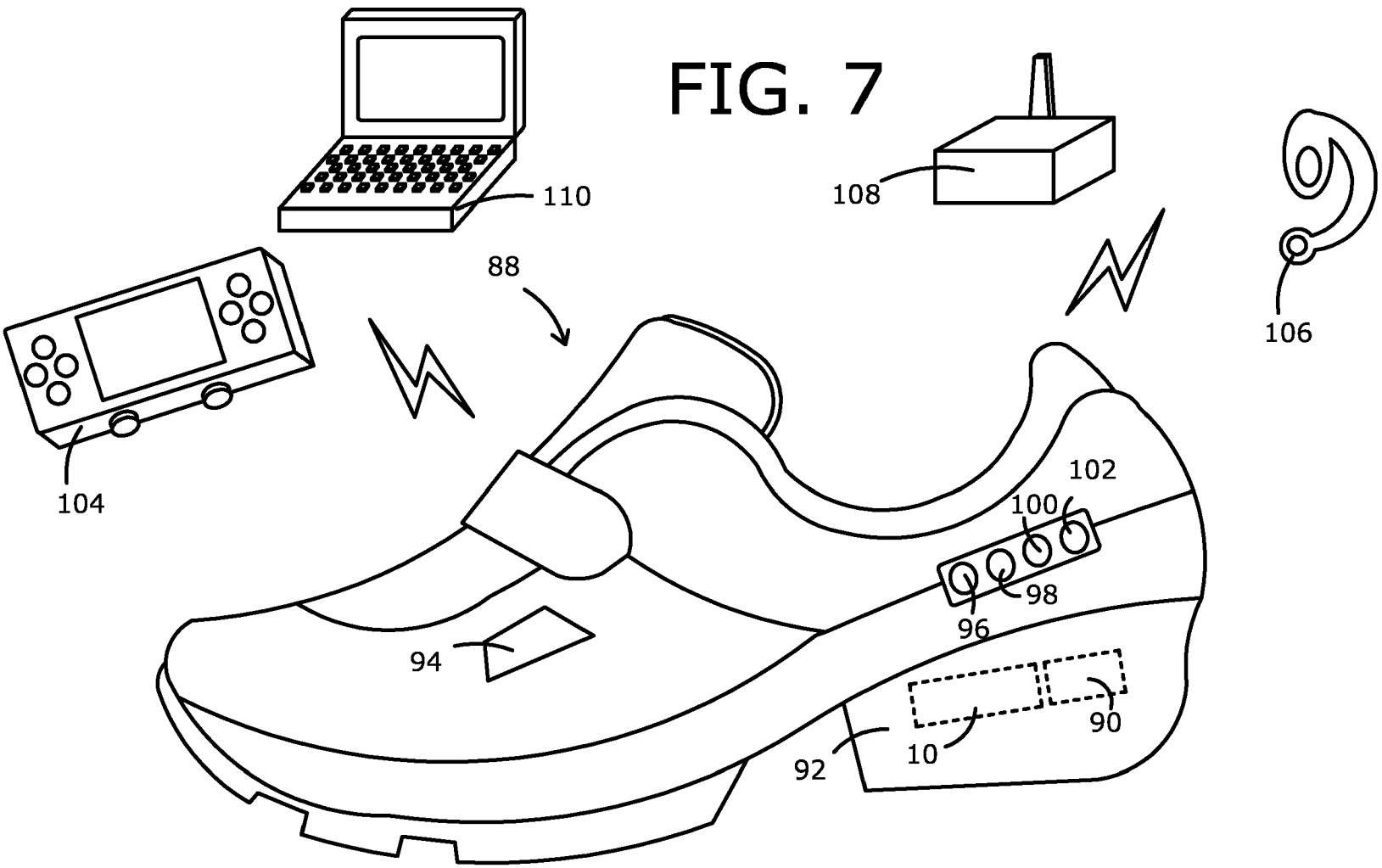
FIG. 7 is a view of the preferred embodiment of the present invention illustrating how it can be used in conjunction with an athletic shoe to provide access to a video game unit or a headpiece.

With reference to FIG. 7, still more uses of the module 10 of the present invention are shown. In particular, an athletic shoe 88 houses the module 10, along with a battery 90, in the sole 92 thereof (as shown in shadow). The shoe 88 preferably includes a GPS antenna 94, and various buttons 96, 98, 100, 102, including those used for power and covert alarm activation, as shown. In that the module 10 can include Bluetooth circuitry 18, WiFi circuitry 20, or both (See, FIG. 1), the module 10 can be used to communicate with a handheld device 104 for game playing, or a Bluetooth earpiece 106, which can be used in conjunction with the GSM module 14 for voice communications. The Bluetooth circuitry 18, or the WiFi circuitry 20, could each be used to provide connection to the Internet via a suitable access point 108 (typically, in the case of WiFi) or to a computer 110 which has either WiFi or Bluetooth capability.

For particular applications, the electronics module 10 can include extended memory capability as part of the control and logic circuitry. In such cases the extended memory can be used to add software capability to the system, or to add additional storage capability to the system. Advantages of then including the Bluetooth circuitry 18 or the WiFi circuitry 20, along with an earpiece 106, as shown in FIG. 7, are that they would allow the module 10 to be used for music downloading (e.g., from the Internet or from a music store), storage, and playback, all without giving up the covert alarm locator aspect of the invention.

Figure 8:
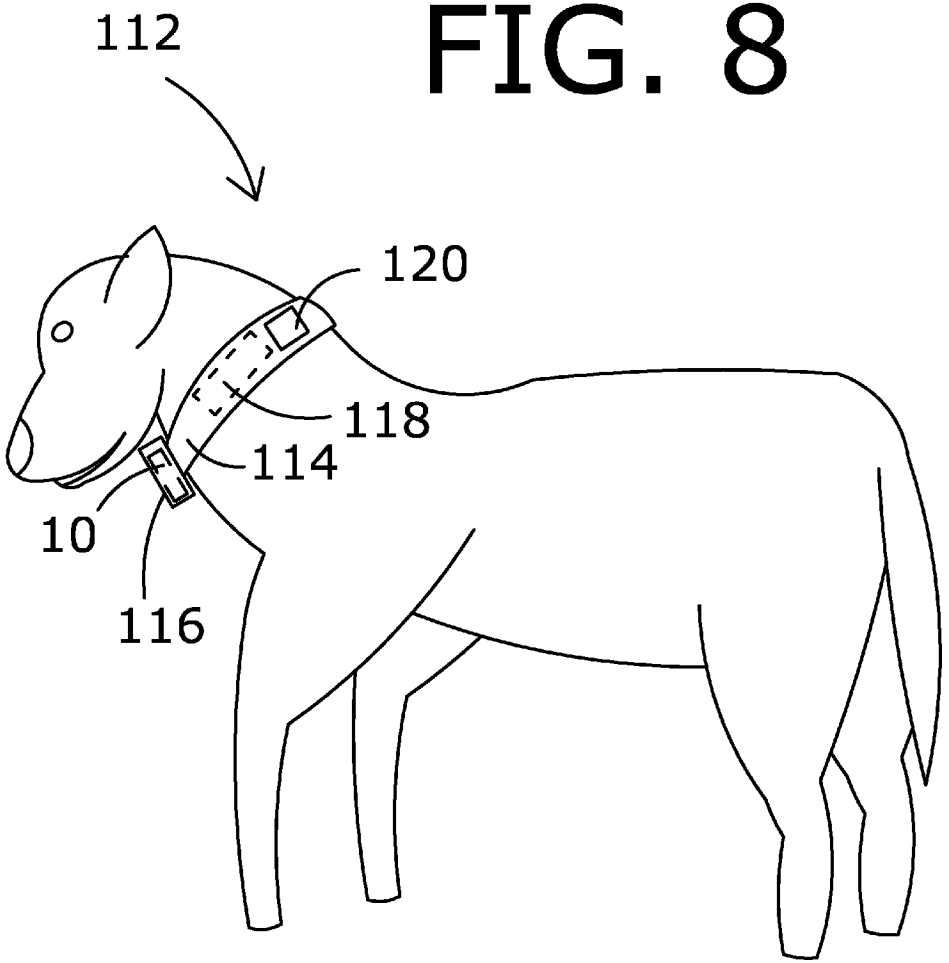
FIG. 8 is a view of the preferred embodiment of the present invention illustrating how it can be used in conjunction with a pet collar to track a dog, should it wander away.

Next, with reference to FIG. 8, a pet dog 112, has a collar 114 which has a receptacle 116 for holding a module 10. The collar 114 also houses a battery 118 and it includes a GPS antenna 120, as shown.

In each of the foregoing examples, the same module 10 can be employed with no modifications to the module 10. Alternatively, the module 10 could exclude various items which are not needed, such as the Bluetooth circuitry 18 or the WiFi circuitry 20, neither of which would be needed to simply track a pet 112, as shown in FIG. 8, thereby making it possible to market a variety of modules 10 having everything from minimal to advanced capabilities, with the purchaser being able to choose those circuits which he expects to use. As the modules 10 are capable of removal from the various items used to house them, it would also be possible for a user who later wishes to "upgrade" to sell or trade in one module for another having advanced capabilities or which uses different communications circuitry, e.g., a cellular phone circuit which uses something other than GSM for a particular market area where GSM is unavailable.

In some market areas, cell phone technology includes GPS technology, with the further benefit that a system of the type described herein could very quickly determine an initial fix based on the cell phone towers which to which it is closest. In such case, the module 10 could be made to incorporate both the location determining circuitry and the communications circuitry as a single component within the module 10.

As alluded to above, a primary benefit of the covert alarm and locator apparatus of the present invention is that it allows the wearer of an article (e.g., footwear) containing the module 10 to maintain privacy while the unit simultaneously conserves battery power by transmitting an alarm signal, encoded with the location of the module 10, as determined by its location determining circuitry 12 using the communications circuitry 14. However, there are times, such as when a child, or a pet, or an Alzheimer's patient is missing when a "proxy" for the wearer (e.g., the parent or guardian of the child, or the pet owner, or the staff of a hospital or other legally responsible party associated with an Alzheimer's patient) will want to act on behalf of the wearer. In such cases, the module 10 necessarily includes two-way communications circuitry 14, such as a GSM cell phone circuitry or satellite based circuitry, with the system design having the capability of permitting the wearer's proxy to remotely activate the transmission of the location encoded alarm signal from the module 10. This aspect of the invention can also be included in an ankle bracelet, similar to the collar 120 shown in FIG. 8, whereby law enforcement personnel can periodically monitor the location of persons who are on restricted probation (e.g., house arrest) or to periodically (or on demand) monitor the location of persons who are subject to restraining orders requiring them to remain away from particular individuals or locations.

As will be understood, the main advantage of providing the "expensive" electronics in a single, removable module 10 is that doing so greatly expands the users' options in terms of how they wish to use the module 10 without increasing their overall cost in doing so.

I claim:

1. An improved covert alarm locator apparatus comprising:

(a) a removable electronics module, said removable electronics module comprising:
  (1) location determining circuitry;
  (2) communications circuitry;
  (3) logic and control circuitry; and
  (4) means for interconnecting said location determining circuitry, said communications circuitry, and said logic and control circuitry to one another and to an external connector;

(b) a wearable or carryable article selected from the group consisting of apparel and carryable items, said article comprising:
  (1) a receptacle for receiving said removable electronics module;
  (2) connection means for making electrical connection to said external connector; and
  (3) a covert activation switch for selectively initiating the transmission of an alarm signal by said communications circuitry, said alarm signal being encoded with the location of said covert alarm locator apparatus as determined by said location determining circuitry; and (c) power supply means for powering said circuitry within said removable electronics module, wherein said location determining circuitry is a GPS receiver which is combined with said communications circuitry in a single cellular phone based unit, whereby the initial fix for said location determining circuitry is based on the location of the nearest cell phone towers, whereby the initial fix can be rapidly and accurately determined.

2. The covert alarm locator apparatus of claim 1 wherein said article further comprises a GPS antenna connected to said connection means.

3. The covert alarm locator apparatus of claim 2 wherein said article further comprises a covert activation switch connected to said connection means.

4. The covert alarm locator apparatus of claim 3 wherein said article is footwear, and said receptacle is formed in the sole thereof.

5. The covert alarm locator apparatus of claim 3 wherein said article is a backpack, and said receptacle is formed inside a pocket thereof.

6. The covert alarm and locator apparatus of claim 3 wherein said article is selected from the group consisting of a glove and a mitten.

7. The covert alarm and locator apparatus of claim 6 wherein said article further comprises a display which can selectively show the speed at which the wearer is moving or the distance of the wearer from a given location.

8. The covert alarm and locator apparatus of claim 7 wherein said article is a golf glove and said logic and control apparatus includes software and memory adapted to load the locations of the pins on a particular golf course therein, and said glove includes input means for enabling the wearer to select the hole whose pin distance is to be shown on said display.

9. The covert alarm locator apparatus of claim 3 wherein said article is a pet collar, and said receptacle is formed in a housing attached thereto.

10. The covert alarm locator apparatus of claim 1 wherein said electronics module further comprises short range communications circuitry.

11. The covert alarm locator apparatus of claim 10 wherein said short range communications circuitry is selected from the group consisting of Bluetooth and WiFi circuitry.

12. The covert alarm locator apparatus of claim 11 wherein said short range communications circuitry comprises Bluetooth circuitry and said communications circuitry comprises cell phone circuitry, whereby said covert alarm locator apparatus can be used as a cell phone in conjunction with a Bluetooth headset.

13. The covert alarm locator apparatus of claim 12 wherein said logic and control circuitry includes software and sufficient memory to enable the downloading of music thereto and the storage of music therein with said music being playable through said Bluetooth headset.

14. The covert alarm locator apparatus of claim 11 wherein said short range communications circuitry can be used to connect to and interact with a nearby game console unit.

15. The covert alarm locator apparatus of claim 11 wherein said short range communications circuitry can be used to connect to the Internet.

16. The covert alarm locator apparatus of claim 11 wherein said short range communications circuitry can be used to provide an internet based connection to a remote monitoring location.

17. The covert alarm locator apparatus of claim 1 wherein said communications circuitry is capable of two-way communications, and said apparatus is adapted to permit the covert activation of a location encoded alarm based on the remote activation through said communications module, as authorized by proxy of the wearer of the apparatus.

18. The covert alarm locator apparatus of claim 1 wherein said communications circuitry is capable of two-way communications, and said communications circuitry is selected from the group consisting of GSM circuitry and satellite communications circuitry.

19. An improved covert alarm locator apparatus comprising:

(a) a removable electronics module, said removable electronics module comprising:
  (1) location determining circuitry;
  (2) communications circuitry;
  (3) logic and control circuitry; and
  (4) means for interconnecting said location determining circuitry, said communications circuitry, and said logic and control circuitry to one another and to an external connector;

(b) a wearable or carryable article selected from the group consisting of a glove or a mitten comprising:
  (1) a receptacle for receiving said removable electronics module;
  (2) connection means for making electrical connection to said external connector; and
  (3) a covert activation switch for selectively initiating the transmission of an alarm signal by said communications circuitry, said alarm signal being encoded with the location of said covert alarm locator apparatus as determined by said location determining circuitry;

(c) power supply means for powering said circuitry within said removable electronics module; and (d) a display which can selectively show the speed at which the wearer is moving or the distance of the wearer from a given location.

20. The covert alarm and locator apparatus of claim 19 wherein said article is a golf glove and said logic and control apparatus includes software and memory adapted to load the locations of the pins on a particular golf course therein, and said glove includes input means for enabling the wearer to select the hole whose pin distance is to be shown on said display.

21. An improved covert alarm locator apparatus comprising:

(a) a removable electronics module, said removable electronics module comprising:
  (1) location determining circuitry;
  (2) communications circuitry comprising cell phone circuitry;
  (3) logic and control circuitry; and
  (4) means for interconnecting said location determining circuitry, said communications circuitry, and said logic and control circuitry to one another and to an external connector;

(b) a wearable or carryable article selected from the group consisting of apparel and carryable items, said article comprising:
  (1) a receptacle for receiving said removable electronics module;
  (2) connection means for making electrical connection to said external connector; and
  (3) a covert activation switch for selectively initiating the transmission of an alarm signal by said communications circuitry, said alarm signal being encoded with the location of said covert alarm locator apparatus as determined by said location determining circuitry;

(c) power supply means for powering said circuitry within said removable electronics module (d) short range communications circuitry comprising Bluetooth circuitry, whereby said covert alarm locator apparatus can be used as a cell phone in conjunction with a Bluetooth headset.

22. The covert alarm locator apparatus of claim 21 wherein said logic and control circuitry includes software and sufficient memory to enable the downloading of music thereto and the storage of music therein with said music being playable through said Bluetooth headset.

23. The covert alarm locator apparatus of claim 21 wherein said short range communications circuitry can be used to connect to and interact with a nearby game console unit.

24. The covert alarm locator apparatus of claim 21 wherein said short range communications circuitry can be used to connect to the Internet.

25. The covert alarm locator apparatus of claim 21 wherein said short range communications circuitry can be used to provide an internet based connection to a remote monitoring location.

* * * * *